US005538567A

United States Patent [19]

Henry, III et al.

[11] Patent Number: 5,538,567

[45] Date of Patent: Jul. 23, 1996

[54] GAS GENERATING PROPELLANT

[75] Inventors: Guy H. Henry, III, Centralia; Matthew S. Solverson, Carbondale, both of Ill.

[73] Assignee: Olin Corporation, Marion, Ill.

[21] Appl. No.: 214,509

[22] Filed: Mar. 18, 1994

[51] Int. Cl.[6] ..... C06B 45/06

[52] U.S. Cl. ..... 149/18; 149/92

[58] Field of Search ..... 149/18, 92

[56] References Cited

U.S. PATENT DOCUMENTS

| | | | |
|---|---|---|---|
| 2,165,263 | 7/1939 | Holm | 102/12 |
| 2,558,756 | 7/1951 | Jackson et al. | 23/281 |
| 3,343,921 | 9/1967 | Braun | 23/281 |
| 3,719,604 | 3/1973 | Prior et al. | 252/186 |
| 3,739,574 | 6/1973 | Godfrey | 60/39.03 |
| 3,797,854 | 3/1974 | Poole et al. | 280/150 AB |
| 3,811,358 | 5/1974 | Morse | 86/20 R |
| 3,839,106 | 10/1974 | de Prisque et al. | 149/19.9 |
| 3,919,013 | 11/1975 | Fox et al. | 149/6 |
| 3,983,818 | 10/1976 | Ciccone et al. | 102/60 |
| 4,072,546 | 2/1978 | Winer | 149/19.8 |
| 4,089,716 | 5/1978 | Goddard et al. | 149/10 |
| 4,094,712 | 6/1978 | Goddard et al. | 149/10 |
| 4,462,848 | 7/1984 | Elrick | 149/19.92 |
| 4,938,813 | 7/1990 | Eisele et al. | 149/19.2 |
| 5,056,436 | 10/1991 | Greene | 102/490 |
| 5,125,684 | 6/1992 | Cartwright | 280/736 |

FOREIGN PATENT DOCUMENTS

| | | |
|---|---|---|
| 851919 | 10/1952 | Germany . |
| 854770 | 11/1952 | Germany . |
| 909424 | 4/1954 | Germany . |

OTHER PUBLICATIONS

Hawley's Condensed Chemical Dictionary—Twelfth Edition. Copyright© 1993 by Van Nostrand Reinhold at pp. 578–1049.

*Primary Examiner*—Peter A. Nelson
*Attorney, Agent, or Firm*—Gregory S. Rosenblatt

[57] ABSTRACT

There is provided a gas generating propellant mix consisting essentially of guanidine nitrate, an oxidizer selected from the group consisting of potassium perchlorate and ammonium perchlorate, a flow enhancer and a binder. When ignited, the propellant mix generates nitrogen, carbon dioxide and steam at an elevated temperature, typically in excess of 800° C. The propellant mix is particularly useful in augmented gas generators to augment the evolution of oxygen from a secondary source such as potassium chlorate. The propellant mix is free of highly toxic compounds and has particular application in automotive airbags.

16 Claims, 1 Drawing Sheet

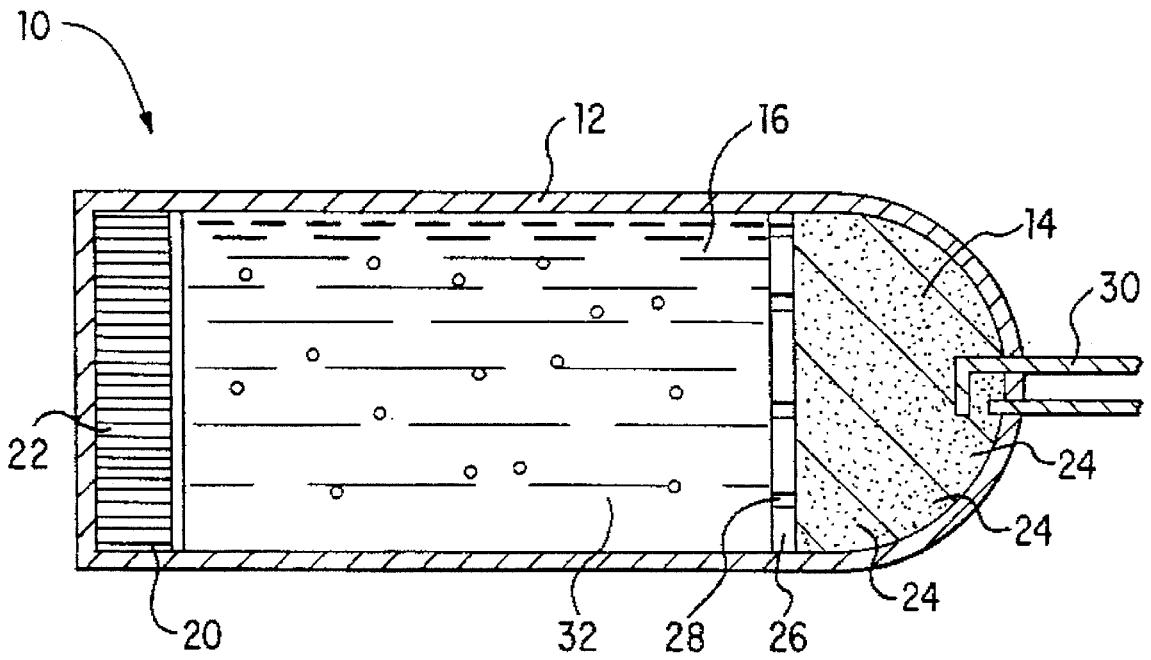
10
12
16
14
30
22
24
24
24
20
32
28
26

GAS GENERATING PROPELLANT

BACKGROUND OF THE INVENTION

This invention relates a gas generating propellant. More particularly, a mixture of guanidine nitrate and a specific oxidizer, potassium perchlorate or ammonium perchlorate, generates nitrogen, carbon dioxide and steam when ignited.

Gas generating compounds evolve a copious volume of gas when ignited. One category of gas evolving compounds utilizes a guanidine ($HN{=}C(NH_2)_2$) based compound mixed with a sensitizer and/or oxidizer. For example, U.S. Pat. No. 2,165,263 to Holm discloses a gas generating compound containing nitroguanidine in a binder. A portion of the nitroguanidine may be replaced with guanidine nitrate ($H_2NC(NH)NH_2{\bullet}HNO_3$). Typical binders include nitrocellulose and cellulose acetate.

U.S. Pat. No. 3,719,604 to Prior et al, discloses a mixture of an oxygen liberating compound, such as potassium chlorate, and a gas evolving compound such as ammonium nitrate or guanidine nitrate.

U.S. Pat. No. 3,739,574 to Godfrey discloses a gas generator containing a mixture of guanidine nitrate and ammonium nitrate which is decomposed in the presence of a chromic oxide catalyst.

The above mixtures evolve a generous quantity of oxygen and nitrogen gases. However, the gas volume and gas temperature is inadequate for use in augmented airbags as utilized in automotive passenger restraint systems. In a first compartment of such an airbag, elevated temperature nitrogen gas is generated by ignition of a mixture of an azide-and an oxidizer. One disclosed mixture is sodium azide and potassium perchlorate. The generated nitrogen passes through a perforated plate into a second compartment containing a pressurized gas which expands on exposure to the hot nitrogen gas generated in the first compartment. In a third compartment, the gases inflate an air bag to restrain an automobile passenger.

Sodium azide is difficult to handle safely and is toxic. Assembly of the airbags must be done in a controlled environment and disposal of uninflated airbag cylinders is difficult.

Guanidine nitrate is easier to handle and not as toxic as sodium azide. The development of a guanidine nitrate based airbag component would improve the safety of manufacture and transport and lessen the environmental concerns of disposal.

SUMMARY OF THE INVENTION

It is an object of the invention to provide a gas generating propellant which evolves a large quantity of nontoxic gases at elevated temperature. It is a second objective of the invention to incorporate this propellant mixture into an augmented airbag. It is a feature of the invention that the propellant is a mixture of guanidine nitrate and an oxidizer. In preferred embodiments, the oxidizer is either potassium perchlorate or ammonium perchlorate. Yet another feature of the invention is that a flow facilitator, such as graphite or carbon black, may be added to the propellant mix. Yet another feature is that a binder such as calcium resinate may be added to the propellant mix.

It is an advantage of the invention that when ignited, the propellant mix generates an exhaust gas having a temperature in excess of about 800° C., which augments the expansion of nitrogen in the second compartment of the augmented gas generator. Yet another advantage of the invention is that the evolved gas travels at a speed in excess of about 530 meters per second, increasing the speed of airbag deployment. Yet another advantage of the invention is that the components added to the propellant mix are less toxic than sodium azide, easier to handle, and safer to dispose.

Accordingly, there is provided a gas generating propellant. The propellant consists essentially of from about 55% to about 75%, by weight, guanidine nitrate, from about 25% to about 45%, by weight, of an oxidizer which is selected from the group consisting of potassium perchlorate and ammonium perchlorate, from about 0.5% to about 5.0%, by weight, of a flow enhancer and, up to about 5%, by weight, of a binder.

In accordance with a second embodiment of the invention, there is provided a component for an augmented airbag. This component contains a primary gas generating propellant mix which is effective to deliver a mixture of nitrogen, carbon dioxide and steam to a secondary gas source. The mix is delivered at a temperature in excess of about 800° C.

The above stated objects, features and advantages will become more apparent from the specification and drawing which follows.

IN THE DRAWINGS

The FIGURE illustrates in cross-sectional representation an augmented airbag utilizing the gas generating propellant of the invention.

DETAILED DESCRIPTION

The FIGURE illustrates in cross-sectional representation an augmented airbag 10. The augmented airbag 10 has a rigid metallic housing 12, such as a carbon steel, formed into a cylinder closed at one end. The cylinder is divided into a plurality of compartments. A first compartment 14 contains the propellant mix of the invention and is described in more detail below. A second compartment 16 contains a compressed gas such as nitrogen under a pressure of 17.2 MPa (2500 psi). The gases pass to a third compartment 20, inflating an airbag 22.

The propellant mix 24 of the invention is contained within the first compartment 14. The first compartment 14 is defined by the closed end of the cylindrical housing 12 and a plate 26 having perforations 28. The propellant mix 24 consists essentially of from about 55% to about 75%, by weight, guanidine nitrate; from about 25% to about 45%, by weight, of an oxidizer selected from the group consisting of potassium perchlorate and ammonium perchlorate; from about 0.5% to about 5.0%, by weight, of a flow enhancer and up to about 5%, by weight, of a binder. Among the suitable flow enhances are graphite and carbon black. One suitable binder is calcium resinate.

In a preferred embodiment, the propellant mix consists essentially of from about 57% to about 71%, by weight, guanidine nitrate; from about 28% to about 42%, by weight potassium perchlorate; and from about 0.5 to about 1.5%, by weight graphite From about 1% to about 3% by weight, calcium resinate as a binder can also be present.

In a most preferred composition, the propellent mix consists essentially of from about 61% to about 67%, by weight, guanidine nitrate; from about 32% to about 38%, by weight, potassium perchlorate; and from about 0.5 to about 1.5%, by weight, graphite. As above, from about 1% to about 3%, by weight, calcium resinate may be present.

When guanidine nitrate is above the maximum compositional limit of the invention, incomplete oxidation occurs and excessive carbon monoxide may be present in the output gas. When the guanidine nitrate content is below the limit of the invention, there is insufficient energy output to generate the temperatures necessary to augment the exhaust of nitrogen from the second compartment 16. Additionally, the gas is generated more slowly decreasing the rate of deployment of the airbag 22.

If the potassium perchlorate content is above the limit of the invention, the amount of gas evolved is insufficient to fully deploy the airbag 22. When the potassium perchlorate content is below the limit of the invention, incomplete oxidation occurs, leading to the potential for excessive carbon monoxide in the output gas.

The flow enhancer is preferably carbon based and selected to be graphite or carbon black. When the flow enhancer content is above the limit of the invention, there is poor oxidation of carbon leading to reduced energy output and the potential for excessive carbon monoxide in the output gas. When the content of the flow enhancer is below the limit of the invention, poor processability results. The flow enhancer enhances the flow of guanidine nitrate and oxidizer into a mold and out of the mold after pressing. If insufficient flow enhancer is present, it is difficult to accurately fill the mold and to remove the pressed propellant mix.

In addition to composition, the particle size is also important. The average particle size of the guanidine nitrate is between 75 microns and 350 microns, and preferably, from about 100 microns to about 200 microns. The average particle diameter of the oxidizer is from about 50 microns to about 200 microns, and preferably, from about 75 to about 125 microns. The average particle size of the flow enhancer is from about 7 microns to about 70 microns, and preferably, from about 15 microns to about 35 microns.

When the particle size of the guanidine nitrate or oxidizer is above the maximum limit of the invention, the burn rate of the propellant is too slow and deployment of the airbag 22 is delayed. When the particle size is below the minimum limit of the invention, the burn rate is too rapid and rather than the controlled evolution of gas, explosive bursting of the housing 12 may occur. When the average particle size of the flow enhancer is above the maximum of the invention, poor lubricity is the result and the benefits of the flow enhancer are lost. Excessively small flow enhancer particle size does not affect the propellant burn performance or processability, but is difficult to handle.

The propellant mix 24 is ignited by an electric squib 30 triggered by an electric sensor (not shown) when a collision is detected. The squib 30 may be any pyrotechnically initiated standard explosive primer such as the Holex 1196A squib (manufactured by Wittaker Ordnance of Holister, Calif.). When ignited, the propellant mix 24 exothermically generates a mixture of nitrogen, carbon dioxide and steam. The gaseous mix is delivered to the second compartment 16 through the apertures 28. To maximize the evolution of oxygen in the second compartment 16, the gaseous mixture is delivered at a temperature in excess of about 800° C., and preferably, at a temperature of from about 900° C. to about 1050° C.

Rapid delivery of the gaseous mix is desirable for rapid deployment of the airbag 22. Preferably, the gaseous mix is delivered to the second compartment 16 at a speed of from about 530 meters per second to about 650 meters per second and most preferably, at a speed of from about 560 meters per second to about 625 meters per second.

The advantages of the propellant mix of the invention will become more apparent from the example which follows. The example is illustrative and not intended to limit the scope of the invention.

EXAMPLE

A propellant mix consisting of, by weight, 64% guanidine nitrate, 35% by weight potassium perchlorate and 1% graphite was computer modelled to determine the exhaust temperature and exhaust speed of the evolved gas. The temperature was 971° C. and the exhaust speed of the gaseous mixture was 593 meters per second. The primary gases evolved mixture were:

1.44 moles $H_2O$ 1.05 moles $N_2$ 0.53 moles $CO_2$ 0.13 moles $H_2$ 0.07 moles CO In addition, 0.19 moles of potassium chloride as a solid was generated. The approximately 2% of the gas mix evolved as carbon monoxide is substantially oxidized to carbon dioxide in the second compartment 16 such that the gas which deploys the airbag 22 is substantially safe.

While the invention has been described in terms of a gas evolving propellant mix for augmented automotive airbags, it is equally applicable to other types of airbags as well as other applications requiring the rapid generation of a large quantity of gas and is useful for applications such as fire extinguishers and pneumatic equipment.

It is apparent that there has been provided in accordance with this invention a gas evolving propellant mixture which fully satisfies the objects, features and advantages set forth hereinabove. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A gas generating propellant used to deploy an air bag, consisting essentially of:

from about 55% to about 75%, by weight, guanidine nitrate;

from about 25% to about 45%, by weight, of an oxidizer selected from the group consisting of potassium perchlorate and ammonium perchlorate;

from about 0.5% to about 5.0%, by weight, of a flow enhancer; and up to about 5%, by weight, of a binder.

2. The gas generating propellant of claim 1 wherein said flow enhancer is selected from the group consisting of graphite and carbon black.

3. The gas generating propellant of claim 2 wherein said binder is calcium resinate.

4. The gas generating propellant of claim 2 consisting essentially of from about 57% to about 71%, by weight, guanidine nitrate, from about 28% to about 42%, by weight, potassium perchlorate and from about 0.5% to about 1.5%, by weight, graphite.

5. The gas generating propellant of claim 4 further containing from about 1% to about 3% by weight calcium resinate.

6. The gas generating propellant of claim 4 wherein the average particle size of said guanidine nitrate is from about 75 microns to about 350 microns, the average particle size of said potassium perchlorate is from about 50 microns to about 200 microns and the average particle size of said graphite is from about 7 microns to about 70 microns.

7. The gas generating propellant of claim 6 wherein the average particle size of said guanidine nitrate is from about 100 microns to about 200 microns, the average particle size of said potassium perchlorate is from about 75 microns to about 125 microns and the average particle size of said graphite is from about 15 microns to about 35 microns.

8. A component of an airbag, comprising:

a primary gas generating propellant mix consisting essentially of from about 55% to about 75%, by weight, guanidine nitrate, from about 25% to about 45%, by weight, of an oxidizer selected from the group consisting of potassium perchlorate and ammonium perchlorate, from about 0.5% to about 5.0%, by weight, of a flow enhancer and up to about 5%, by weight, of a binder that is effective to deliver a mixture of nitrogen, carbon dioxide and steam to a secondary gas source, said mixture being delivered at a temperature in excess of about 800° C.

9. The component of claim 8 wherein said mixture is delivered at a temperature of from about 900° C. to about 1050° C.

10. The component of claim 8 wherein said mixture is delivered at a speed of from about 530 meters per second to about 650 meters per second.

11. The component of claim 10 wherein said mixture is delivered at a speed about 560 meters per second to about 625 meters per second.

12. The component of claim 10 wherein said flow enhancer is selected from the group consisting of graphite and carbon black.

13. The component of claim 12 wherein said binder is calcium resinate.

14. The component of claim 12 wherein said gas generating propellant mix consists essentially of from about 57% to about 71%, by weight, guanidine nitrate, from about 28% to about 42%, by weight, potassium perchlorate and from about 0.5% to about 1.5%, by weight, graphite.

15. The component of claim 14 further containing from about 1% to about 3% calcium resinate.

16. The component of claim 14 wherein the average particle size of said guanidine nitrate is from about 75 microns to about 350 microns, the average particle size of said potassium perchlorate is from about 50 microns to about 200 microns and the average particle size of said graphite is from about 7 microns to about 70 microns.

* * * * *